US006805239B2

(12) United States Patent
Smarr et al.

(10) Patent No.: US 6,805,239 B2
(45) **Date of Patent: *Oct. 19, 2004**

(54) SUPPORT FOR LARGE ROLLS OF MATERIAL

(75) Inventors: Eric Smarr, Columbia, SC (US); Melvyn J. Leeb, 2316 Velvet Ridge Dr., Owings Mills, MD (US) 21117

(73) Assignee: Melvyn J. Leeb, Owings Mills, MD (US)

( * ) Notice: Subject to any disclaimer, the term of this patent is extended or adjusted under 35 U.S.C. 154(b) by 184 days.

This patent is subject to a terminal disclaimer.

(21) Appl. No.: 10/173,951

(22) Filed: Jun. 17, 2002

(65) Prior Publication Data

US 2003/0230505 A1 Dec. 18, 2003

(51) Int. Cl.[7] ..... B65D 85/66
(52) U.S. Cl. ..... 206/416; 206/397
(58) Field of Search ..... 206/389, 397, 206/407, 409, 410, 413–416, 497; 242/170, 171, 588.6, 598

(56) References Cited

U.S. PATENT DOCUMENTS

| | | | | | |
|---|---|---|---|---|---|
| 2,864,493 | A | * | 12/1958 | Holcombe | 242/588.6 |
| 3,332,546 | A | * | 7/1967 | De George | 206/395 |
| 3,837,480 | A | * | 9/1974 | Brunett | 206/497 |
| 4,027,794 | A | * | 6/1977 | Olson | 206/395 |
| 4,151,914 | A | * | 5/1979 | Blatt | 206/386 |
| 4,444,313 | A | * | 4/1984 | Tyson | 206/397 |
| 5,704,479 | A | * | 1/1998 | Barnett et al. | 206/395 |

* cited by examiner

*Primary Examiner*—Luan K. Bui
(74) *Attorney, Agent, or Firm*—Armstrong, Kratz, Quintos, Hanson & Brooks, LLP

(57) ABSTRACT

An end cap support system for a roll of material on a core which is in a crate or carton for shipping and storage. Two end cap supports each have an opening therein in which the protruding ends of the core are received. The end cap supports are formed from first and second portions made of laminated layers of corrugated board between which is sandwiched a rigid center portion.

1 Claim, 5 Drawing Sheets

SUPPORT FOR LARGE ROLLS OF MATERIAL

BACKGROUND OF THE INVENTION

1. Field of the Invention

The present invention relates to very large rolls of material wound on a core and more particularly to end cap supports for the rolls of material in storage or shipping.

2. Description of Related Art

Continuous rolls of material such as tape, paper, plastic film, fabrics are stored and shipped on central cores or spools around which the material is wound. These rolls may be several feet long and may weigh about 2,000 pounds (jumbo rolls). The core protrudes beyond the outer ends of the material and the protruding core is supported by end caps within a carton, crate or shrink wrap.

At the present time, an end cap is formed from an expanded polystyrene panel which is glued to a wooden sheet. There are several problems with these end caps. The glue sometimes fails so that the foam separates from the wood. The core then rests on the foam which, by itself, is incapable of supporting the weight. The roll then rests on the shipping carton or crate and is difficult to remove. Sometimes the heavy roll shifts during transport and may damage the shipping vehicle or may damage the material on the roll. The polystyrene is not biodegradable and disposal introduces environmental problems. Further, the wooden sheet must be the same size as the polyethylene panel for maximum strength and preparation of the end cap is relatively costly since there is waste in cutting the wooden sheet to the required size. Thus, for economy, the wooden sheet is often smaller than the polystyrene panel and maximum support is not provided.

Thus, there is a need for a less expensive, biodegradable and sturdy end cap which does not fail because of gluing deficiencies.

BRIEF SUMMARY OF THE INVENTION

It is an object of the present invention to provide an end cap support for jumbo rolls of material which are sturdy and do not deteriorate.

It is another object of the present invention to provide an end cap support which is biodegradable.

It is a further object of the present invention to provide an end cap support which is less costly than the end cap supports which are presently available.

In accordance with the teachings of the present invention, there is disclosed, in combination with a jumbo roll of material, wherein the roll is on a central spool having respective ends protruding beyond the roll, an end cap support for each protruding end of the spool. Each end cap support has an opening for receiving the respective protruding end of the spool. Each end cap support has a laminated structure including a central rigid panel and further includes corrugated sheets bonded on each side of the central rigid panel.

In further accordance with the teachings of the present invention, there is disclosed an end cap support system for a roll of material on a core. The core has opposite ends extending beyond the roll of material contacting the end cap system. The system has a pair of end caps. Each end cap has an opening in approximately the center thereof, wherein the opposite ends of the core are received in the respective openings in the end caps. Each end cap has a first portion and an opposite second portion, a center portion being sandwiched between the first portion and the second portion. The first portion and the second portion each are formed of a plurality of layers of corrugated board, the layers being adhered together. The center portion is formed from a rigid material.

In still further accordance with the teachings of the present invention, there is disclosed a storage and shipping container for a roll of material wound about a center core. An outer carton has a top, a bottom, a front, a back and two opposite end walls. A pair of end cap supports is provided, each end cap support being disposed adjacent to a respective end wall of the outer carton. Each end cap support has an opening therein. Each end cap has a first portion separated from a second portion. A mid-portion is sandwiched between the first portion and the second portion. The core has a first end and an opposite second end. The first end and the second end of the core protrudes beyond the roll of material. The first end of the core is received in the opening in one of the end cap supports and the second end of the core is received in the opening in the other of the end cap supports. In this manner, the core with the roll of material is supported in the end cap supports within the storage and shipping container.

These and other objects of the present invention will become apparent from a reading of the following specification taken in conjunction with the enclosed drawings.

DESCRIPTION OF THE PREFERRED EMBODIMENTS

Figure 1:
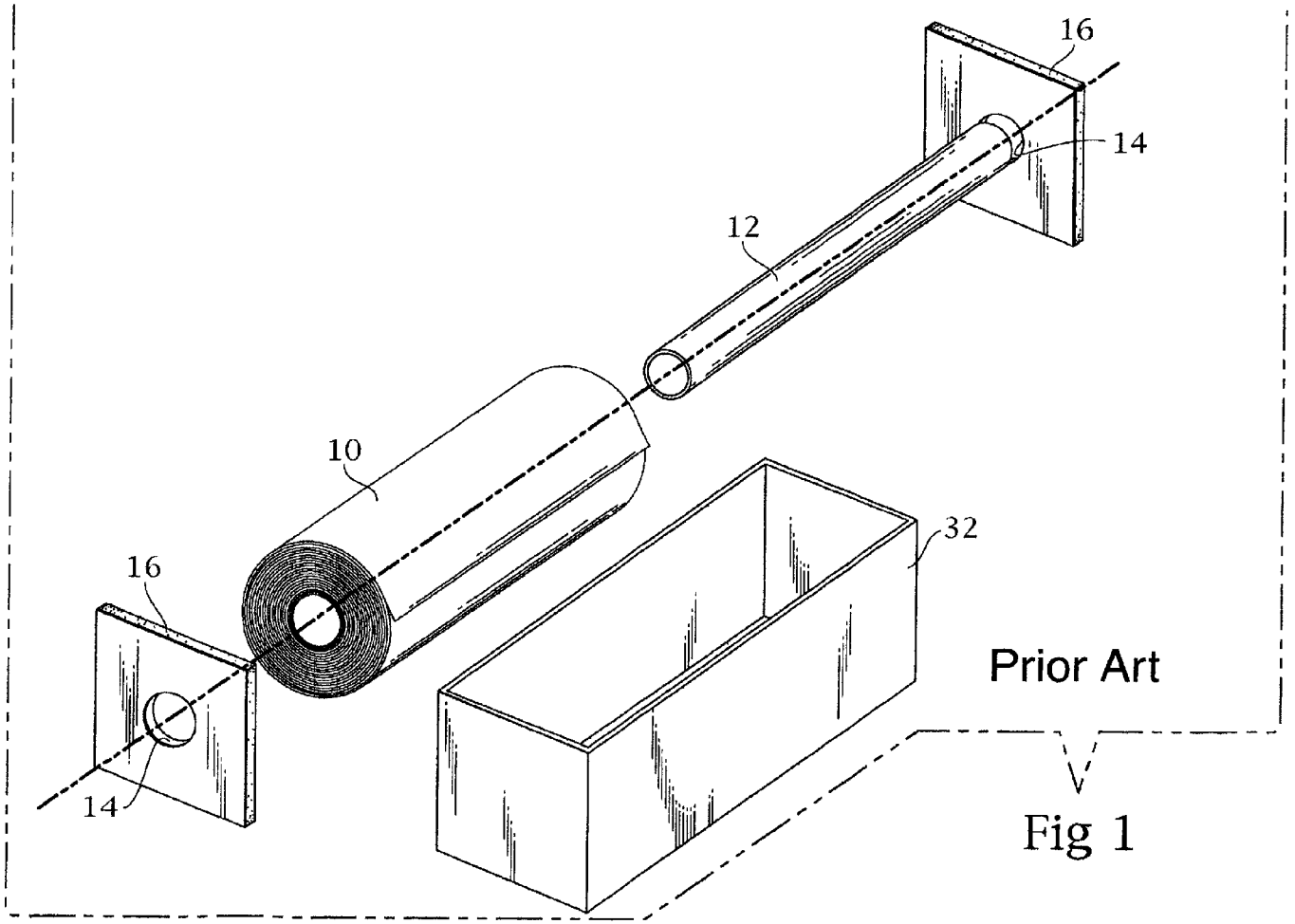
FIG. 1 is an exploded view of the prior art.
Figure 2:
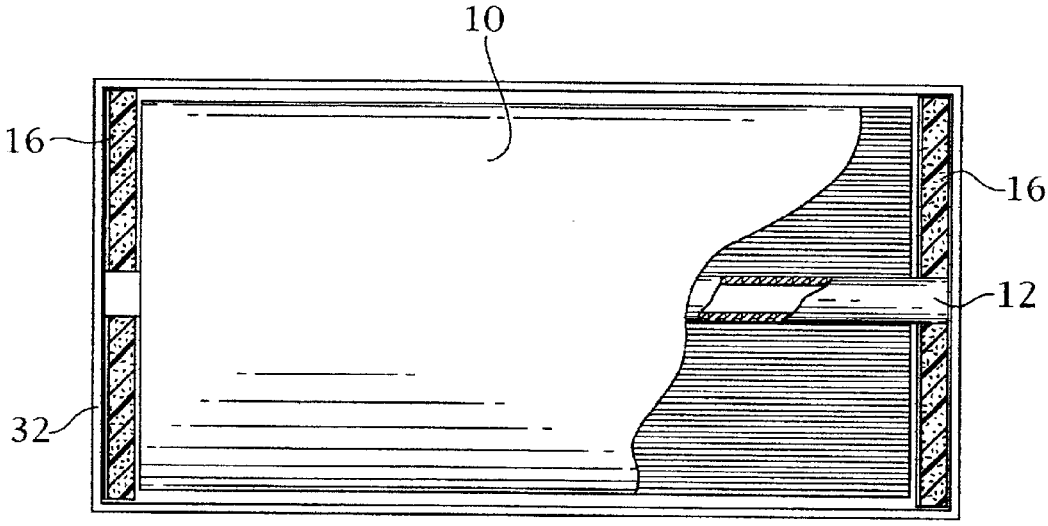
Prior Art Fig 2
FIG. 2 is a partial cross-sectional view of the prior art.
Figure 3:
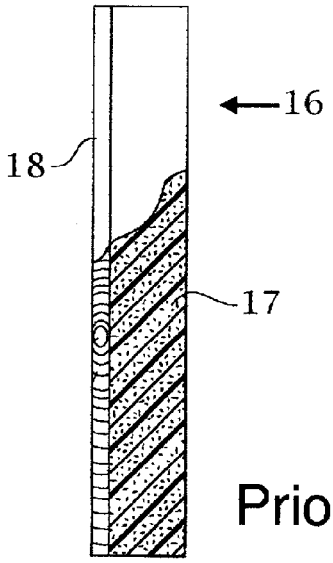
Prior Art Fig 3
FIG. 3 is a cross-sectional view of an end cap support of the prior art.

As shown in FIGS. 1–3, the prior art has a roll of material 10 wrapped around a spool (or core) 12. The ends of the spool which protrude outwardly from the roll of material are received in an opening 14 in each of the end cap supports 16. The end cap supports 16 are formed from polystyrene foam 17 which is glued to a wooden panel 18. The wooden panel 18 generally has a smaller area than the area of the polystyrene panel 17. The glue frequently fails and the wood separates from the polystyrene. The polystyrene by itself does not have the strength to support the weight of the roll of material and the polystyrene end cap support collapses.

Figure 4:
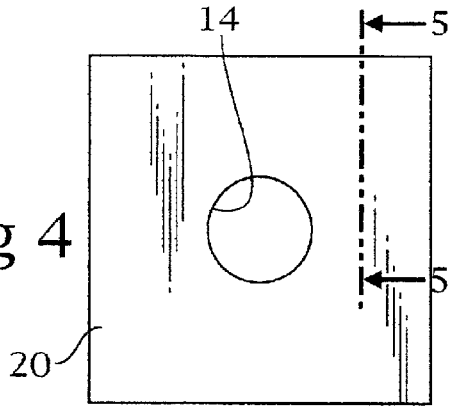
FIG. 4 is a front view of the end cap support of the present invention.
Figure 5:
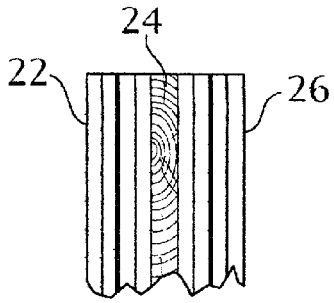
FIG. 5 is an enlarged cross-sectional view taken across the lines 5—5 of FIG. 4.
Figure 6:
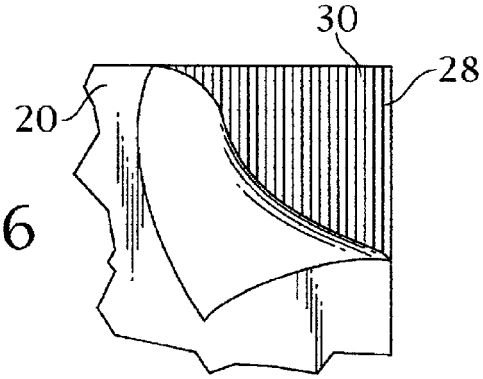
FIG. 6 is an enlarged view of a peeled back corner of FIG. 4.
Figure 7:
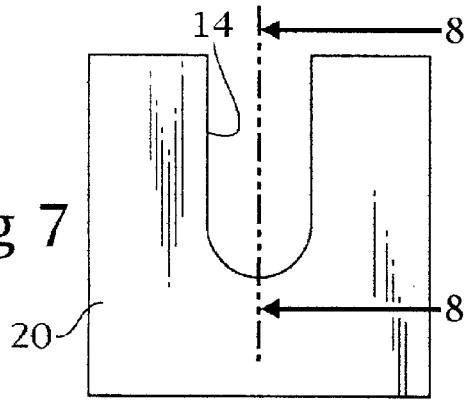
FIG. 7 is a front view of an alternate embodiment of the end cap support of the present invention.
Figure 8:
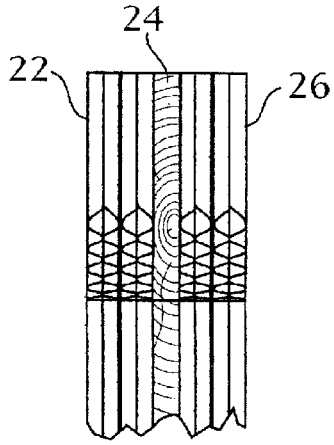
FIG. 8 is an enlarged cross-sectional view taken across the lines 8—8 of FIG. 7.
Figure 9:
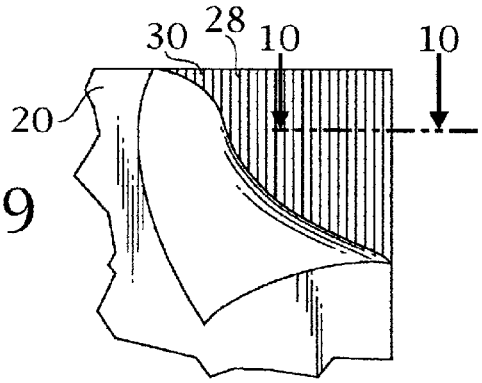
FIG. 9 is an enlarged view of a peeled back corner of FIG. 8.

The end cap support 20 of the present invention (FIGS. 4–6) is formed from a first portion 22 and a second portion 24, each being corrugated board. A center portion 24 is sandwiched between the first portion 22 and the second portion 26. The center portion is formed from a rigid material. The rigid material may be wood, preferably a heavier plywood, paper board, fiber board, compressed newspaper, plastic or other materials known to persons skilled in the art. The plywood may be laminated sheets or may be pressed board. The center portion 24 is glued to both the first portion 22 and the second portion 26. The first portion 22 and the second portion 26 preferably are at least two layers laminated and glued together. The first portion 22 and the second portion 26 may be formed by folding a single sheet of corrugated board in half and gluing the two halves together. The corrugated board has a plurality of alternating ribs 28 and channels 30 between outer layers of heavy paper. The corrugated board in each of the first portion 22 and the second portion 26 of each end cap support 20 are oriented in a vertical manner such that the ribs and channels extend between the top and the bottom of each end cap support 20. The first portion 22, the second portion 26 and the center portion 24 are identical in dimensions with respect to height and width. The thickness of the first portion 22, the second portion 26 and the center portion 24 are not critical and may vary depending upon the weight of the roll of material 10. Usually, the center portion 24 has a thickness of approximately ¼" and the first and second portion each have a thickness of approximately ⅞". However, these thicknesses may vary and are not limiting. The height for the end cap support 20 is greater than the combined diameter of the core 12 and the roll of material 10 wound around the core 12.

Each end cap support 20 has an opening 14 formed therein. Preferably, the opening is circular and is in approximately the center of the end cap support although the opening may be in another location. The opening 14 preferably is a through opening extending through the first, second and center portions. Typically, the opening has a diameter of about 6½" but is not so limited. However, the opening does not necessarily extend through all three portions but may be through the first portion, the center portion and partially through the third portion. In this manner, the protruding end of the core 12 is received in the opening 14 and is supported by at least the first portion and the center portion. Maximum support for the core 12 is provided with a through opening 14 so that the protruding end of the core extends completely through the end cap support 20.

In an alternate embodiment (FIGS. 7–10) the opening 14 is a U-shaped channel extending from the top of each end cap support 20 toward the center of the respective end cap support 20. This embodiment permits easier installation of the protruding end of the core 12 into the opening 14. Also, since the U-shaped opening is formed from the top of the end cap support 20, the vertical orientation of the corrugation is assured to provide maximum strength to the end cap support 20. There is no possibility of having the end cap support 20 disposed on its side with respect to the core.

Figures 10, 11:
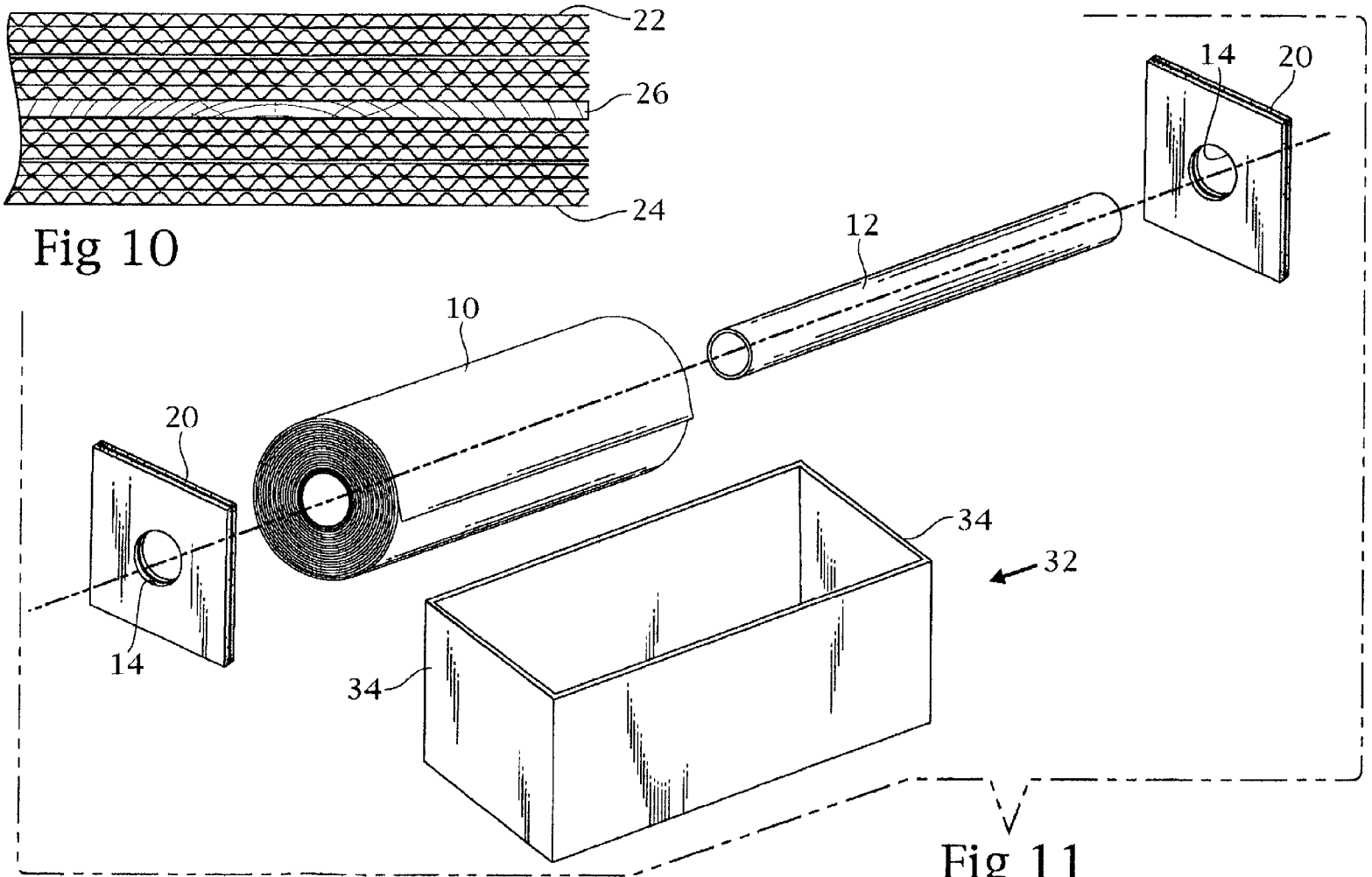
FIG. 10 is a cross-sectional view taken across the lines 10—10 of FIG. 9.
FIG. 11 is an exploded view of the system of the present invention.
Figure 12:
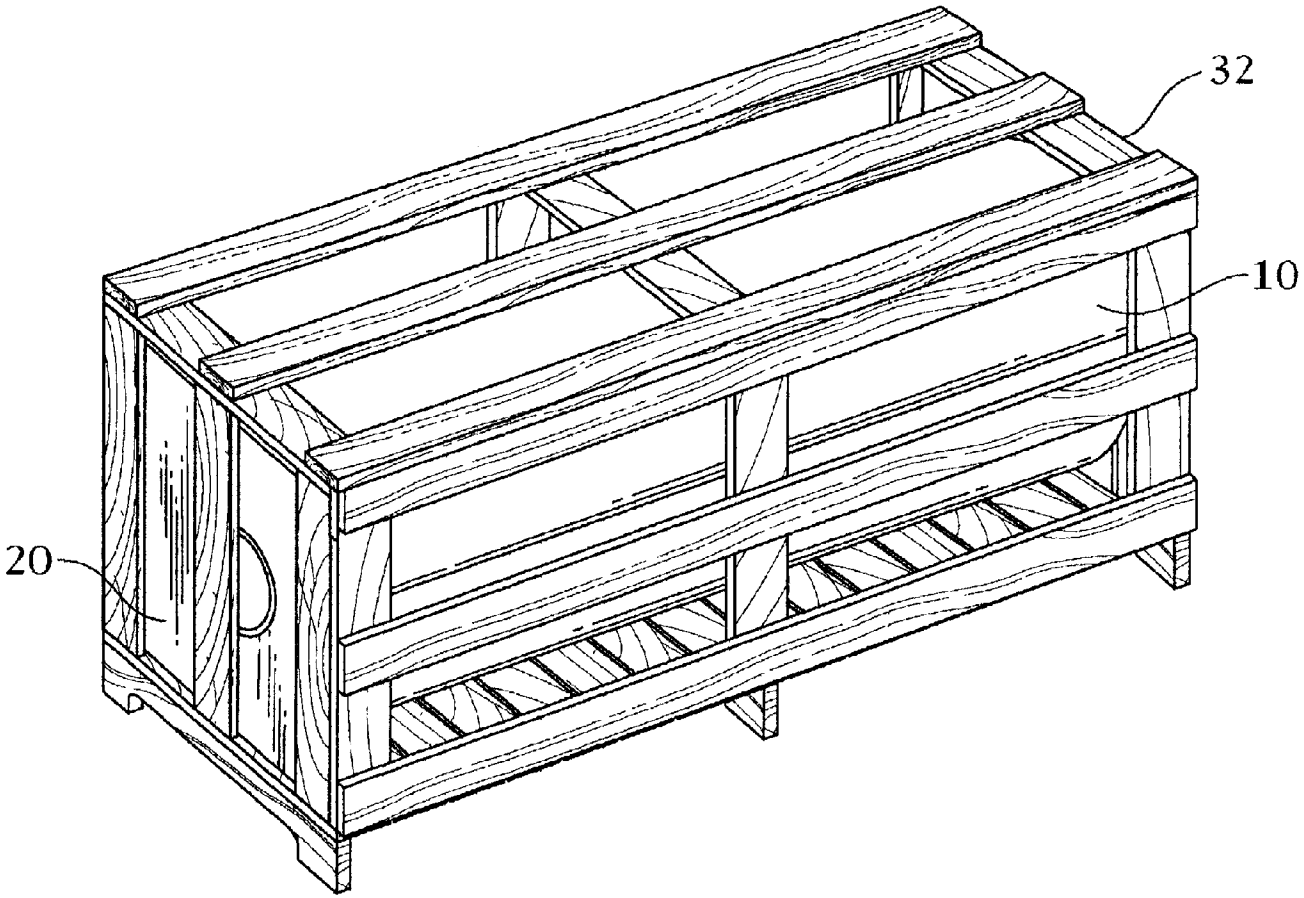
FIG. 12 is a perspective view of the crate of the present invention.

FIGS. 11 and 12 show a storage and shipping container for a jumbo roll of material 10 wound about a core 12. Inside an outer crate, carton or shrink wrapped cover 32, the end cap supports 20 are disposed adjacent to the opposite end walls 34 of the container 32. The ends of the core 12 which protrude beyond the roll of material 10 are received in the respective openings 14 on the end cap supports 20. The container 32 is closed and may be stored or shipped with the contents secure therein. The container may be formed from corrugated board, wood, shrink wrapper or other materials known to persons skilled in the art. The container may have a bottom portion formed as a pallet to facilitate moving the container by use of a forklift vehicle.

The use of corrugated board, paper board, fiber board, compressed newspaper, plastic or wood in the end cap supports 16 provides biodegradable materials which meet environmental needs. The polystyrene foam of the prior art is not biodegradable. The core 12 may be formed from spiral wound paper, board, plastic or other material known to persons skilled in the art. Also, the end core supports 16 of the present invention are more economical to produce than the end core supports which are presently used.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In combination with a jumbo roll of material, wherein the roll is on a central spool having respective ends protruding beyond the roll, an end cap support for each protruding end of the spool, each end cap support having an opening for receiving the respective protruding end of the spool, and each end cap support comprising a laminated structure including a central rigid panel and further including corrugated sheets bonded on each side of the central rigid panel, and wherein the rigid panel is formed from plastic.

* * * * *